United States Patent [19]

Arreghini et al.

[11] Patent Number: 4,757,699

[45] Date of Patent: Jul. 19, 1988

[54] LAUNDRY WASHING AND DRYING MACHINE WITH IMPROVED HEATER

[75] Inventors: Luigi Arreghini, Venice; Piero Durazzani, Pordenone, both of Italy

[73] Assignee: Industrie Zanussi S.p.A., Pordenone, Italy

[21] Appl. No.: 28,684

[22] Filed: Mar. 20, 1987

[30] Foreign Application Priority Data

Apr. 9, 1986 [IT] Italy ..... 45718 A/86

[51] Int. Cl.[4] ..... D06F 39/04

[52] U.S. Cl. ..... 68/16; 68/20; 219/312; 219/314

[58] Field of Search ..... 68/15, 16, 19.2, 20; 219/312, 314, 297

[56] References Cited

U.S. PATENT DOCUMENTS

| | | | |
|---|---|---|---|
| 4,024,735 | 5/1977 | Marchiselli | 68/16 |
| 4,154,003 | 5/1979 | Müller . | |
| 4,270,281 | 6/1981 | Müller | 34/77 |
| 4,580,421 | 4/1986 | Babuin et al. | 68/16 |

FOREIGN PATENT DOCUMENTS

| | | | |
|---|---|---|---|
| 230071 | 4/1959 | Australia | 68/20 |
| 0146719 | 7/1985 | European Pat. Off. . | |
| 234908 | 5/1911 | Fed. Rep. of Germany . | |
| 124712 | 4/1928 | Switzerland | 219/312 |
| 324164 | 10/1957 | Switzerland | 68/16 |
| 2044297 | 10/1980 | United Kingdom | 68/20 |
| 2075559 | 11/1981 | United Kingdom | 68/19.2 |

*Primary Examiner*—Harvey C. Hornsby
*Assistant Examiner*—S. Gerrity
*Attorney, Agent, or Firm*—Wenderoth, Lind & Ponack

[57] ABSTRACT

A laundry washing machine includes a wash tub, a basket for receiving laundry and mounted for rotation within the wash tub, a recirculating duct extending from the bottom of the wash tub to an upper portion thereof, and a pump for recirculating the washing liquid through the duct from the bottom of the wash tub to the upper portion thereof. A housing is attached to the top of the wash tub to define a chamber, and the duct extends into the housing such that the washing liquid pumped by the pump through the duct is discharged into the chamber. Heater elements are located within the chamber to thereby heat the washing liquid discharged into the chamber. The interior of the chamber communicates with the interior of the wash tub through an overflow weir. The machine further may include an air drying circuit whereby air is recirculated through an air duct by means of a fan from the bottom of the wash tub to the chamber, wherein the recirculated air is heated by the heating elements.

6 Claims, 2 Drawing Sheets

LAUNDRY WASHING AND DRYING MACHINE WITH IMPROVED HEATER

BACKGROUND OF THE INVENTION

The present invention relates to an electric laundry washing machine, particularly for domestic use, wherein a wash liquor or washing liquid is caused to recirculate through the wash tub to wet the laundry therein to carry out a washing operation with considerable savings in use of water, detergent and energy.

A laundry washing machine of this general principle would also adapt to perform the traditional washing cycles by soaking the laundry as described in European Patent Application No. 0,146,719. Such washing machine includes a wash tub with a basket receiving laundry and mounted for rotation within the wash tub, and a container or sump is connected to the lower portion or bottom of the wash tub and collects therefrom the washing liquid which is to be recirculated back to an upper portion of the wash tub. Within the container or sump are located electrical resistor heaters for heating the washing liquid. A pump then withdraws the thus heated washing liquid from the container or sump and passes it through a conduit or duct that leads into the upper portion of the wash tub to thereby discharge the heated washing liquid into the wash tub to wet the laundry within the perforated basket spinning within the wash tub.

This known washing machine, although functionally correct, can be improved structurally with regard to the hydraulic circuit thereof, and also can be supplemented conveniently with a drying circuit so as to provide for a more complete processing of the laundry. Indeed, the positioning of the container or sump for collection of the washing liquid in the lower part of the machine results in assembly problems, given the necessary limited space available due to the small and standardized dimensions of domestic washing machines. Furthermore, filtering devices and controls are necessary in order to prevent lint and mineral deposits that are damaging to the electrical resistor heaters from being accumulated in the container or sump. Accordingly, it would preferably to position the collecting container or sump at the upper part of the washing machine. Indeed, a solution of this general type was proposed in 1910 in German Pat. No. 234,908. However, in such known arrangement, the container or tank for collecting and heating the washing liquid is provided externally of the washing machine, and the washing liquid passes therethrough from top to bottom, reentering the tub through a hollow shaft of the basket.

In addition to the complex and bulky construction of this machine, which indeed is not feasible with regard to domestic washing machines, this arrangement has additional inherent and serious disadvantages. Indeed, a heavy consumption of energy is necessary in order to sufficiently heat the water flowing continuously through the collecting container or tank, unless closure valves are provided between the collecting tank and the wash tub. Furthermore, the hydraulic pressure losses along the connecting pipes between the collecting tank and the wash tub reduce substantially the efficiency of the jets of washing liquid issuing from sprinklers disposed along the jacket of the basket containing the laundry. Finally, this known machine does not provide any capability of drying the laundry.

More recently, there have become known machines of the combined washing and drying type wherein laundry is not only washed, but also is dried. However, in such known machines, washing is effected in a traditional manner with the soaking of the clothes, and the washing and drying circuits usually are separated, except for the possible use of water from the water supply main also being employed for condensing water vapor resulting from the drying operation. Hence, machines of this type are complex structurally and are not economical from an operational point of view. One such machine is disclosed in U.S. Pat. No. 4,154,003. The recent development of recirculation-type laundry washing machines, in which heating elements are disposed externally of the wash tub, affords the possibility of the advantageous construction of a combined appliance for washing and drying of laundry.

SUMMARY OF THE INVENTION

With the above discussion in mind, it is an object of the present invention to provide a laundry washing machine of the above type but wherein heating of the washing liquid is achieved in an improved manner.

It is a further object of the present invention to provide such a laundry washing machine of improved design and construction and which is capable of more efficient operation than known machines.

It is a yet further object of the present invention to provide such a laundry washing machine which also may be modified to enable the machine to also dry laundry.

These and other objects of the present invention are achieved by the provision of a laundry washing machine including a wash tub, a basket for receiving laundry and mounted for rotation within the wash tub, a recirculating duct extending from the bottom of the wash tub to an upper portion thereof, pump means for recirculating washing liquid through the duct from the bottom of the wash tub to the upper portion thereof, and electrical resistor heating means located externally of the wash tub for heating washing liquid prior to passage thereof to the upper portion of the wash tub. In particular accordance with the present invention, a housing is attached to the top of the wash tub to define a chamber. The recirculating duct extends into the housing such that washing liquid pumped by the pump means through the duct is discharged into the chamber. The electrical resistor heating means is located within the chamber. Means, positioned within the chamber and connected to the interior of the wash tub, defines a weir for the overflow of washing liquid collected into the chamber into the interior of the wash tub. In other words, in accordance with the present invention, the washing liquid is heated just prior to its recirculation back into the wash tub, thereby avoiding any substantial heat loss or dissipation.

In further accordance with the present invention the washing machine may be supplemented with an arrangement for drying of the laundry. Thus, there is provided a fan for recirculating air from the bottom of the wash tub back to the upper portion thereof through the chamber. Specifically, an air duct extends from the bottom of the wash tub to the chamber, and the fan is located within the duct to recirculate air back to the chamber and then into the upper portion of the wash tub. The recirculated drying air is heated in the chamber by the electrical resistor heating means.

BRIEF DESCRIPTION OF THE DRAWINGS

Other objects, features and advantages of the present invention will be apparent from the following detailed description of nonlimiting embodiments of the present invention, with reference to the accompanying drawings, wherein.

DETAILED DESCRIPTION OF THE INVENTION

Figure 1:
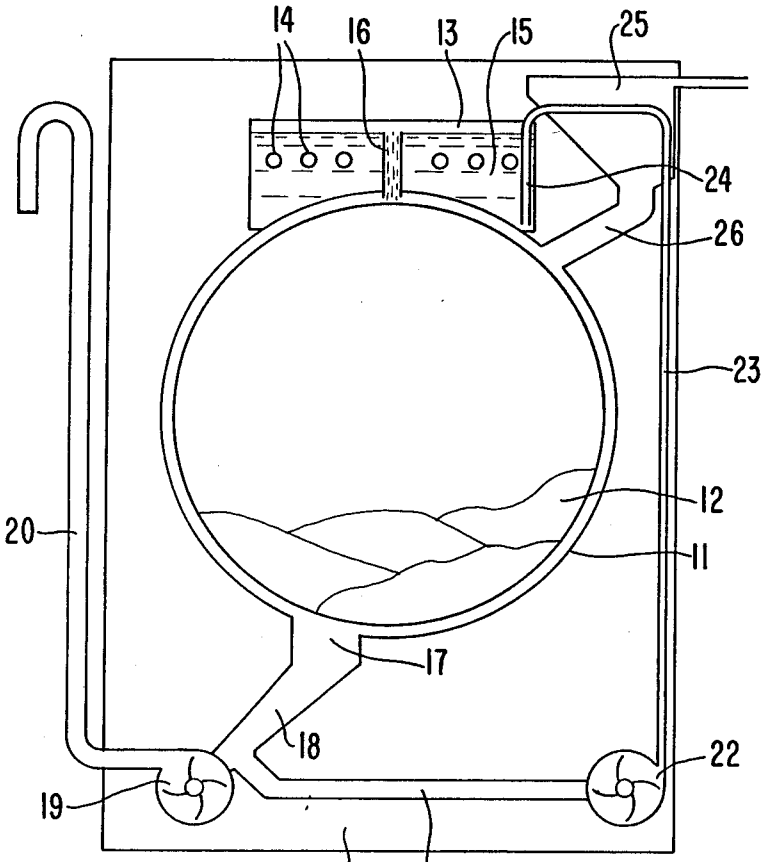

One embodiment of a laundry washing machine according to the present invention is illustrated in FIG. 1. The machine includes a cabinet 10 within which is mounted a wash tub 11. A basket 12 for receiving laundry is mounted for rotation within wash tub 11. Cabinet 10 requires no modification from commercially available and conventional cabinets and may correspond to standardized dimensions. Basket 12 is mounted within wash tub 11 to spin or rotate therein by means of conventional support and drive arrangements. On the other hand, wash tub 11 is modified in accordance with the present invention. Thus, to the exterior top of wash tub 11 is fastened a housing 15 which defines therein a chamber 13. The housing may be made from the same material as wash tub 11, for example stainless steel, and preferably is welded thereto. In the central zone of chamber 13, at the peak or apex of wash tub 11, is provided at least one vertical pipe 16 which causes chamber 13 to communicate freely with the interior of wash tub 11. Conduit or pipe 16 forms a weir for the overflow of washing liquid collected within chamber 13 into wash tube 11. This washing liquid penetrates through perforations in the jacket of basket 12 to thereby wet laundry positioned therein.

The bottom of wash tub 11 is provided with a port 17 connected via a pipe 18 to a drain pump 19 which is operable during a discharge cycle of the machine to discharge washing liquid from the bottom of wash tub 11 through a drain pipe 20, for example at the end of each washing cycle. Drain pump 19 or pipe 18 also is connected via a conduit 21 to a recirculation pump 22 which passes washing liquid from the bottom of wash tub 11 to chamber 13 via recirculation pipe 23. Thus, pipes 18, 21, 23 define a recirculation duct through which washing liquid is recirculated from the bottom of wash tub 11 to chamber 13 by means of pump 22.

Recirculation pipe 23 includes a discharge end length portion 24 which extends to a position in close proximity to the bottom of chamber 13. As a result, end portion 24 thereby forms a siphon which may be used to remove washing liquid collected in chamber 13. Thus, at particular times during the washing cycle it is desirable to withdraw washing liquid from chamber 13, for example when pump 22 stops pumping. This makes it possible to ensure that chamber 13 is kept clean, thereby preventing water stoppages and deposits of lint and deposits within chamber 13. This is particularly important in view of the fact that electrical resistor heaters 14 for heating the recirculating washing liquid are located within the interior of chamber 13. As a result, the washing liquid is heated shortly before discharge into the washing tub, thereby avoiding heat loss or dissipation.

FIG. 1 shows the conventional arrangement for initial supply of water to the wash tub. Thus, the water supply is from a water main connected to a detergent distributor 25 which is connected to the interior of wash tub 11 by a conduit or flexible sleeve 26. Distributor 25 preferably is housed in the upper part of cabinet 10.

Figure 2:
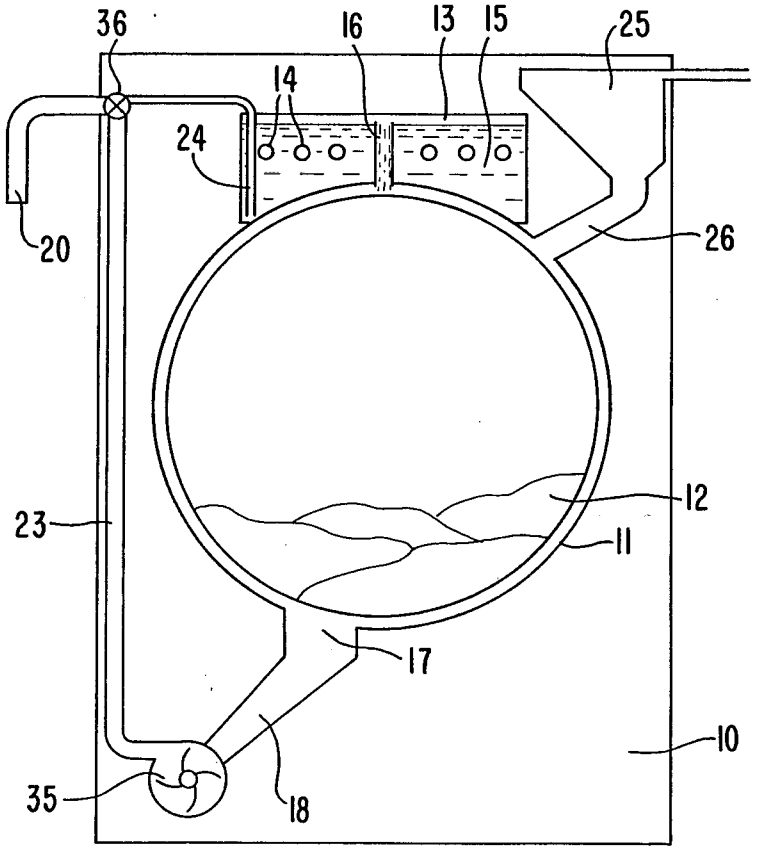
FIGS. 1 and 2 are schematic views of two embodiments of the improved laundry washing machine of the present invention.

FIG. 2 illustrates a modified embodiment of the present invention which however is based on the same basic operating principle as the embodiment shown in FIG. 1. Thus, in FIG. 2 the structure of the machine and operation thereof is somewhat simplified, since there is employed a single pump 35 in place of the two pumps 19, 22 employed in the embodiment of FIG. 1. Single pump 35 operates to achieve both the functions of draining and recirculation of washing liquid. In this arrangement, a valve, such as a two-way deflector valve 36, is located in pipe 23 to selectively control the discharge of washing liquid pumped by pump 35 to chamber 13 or to drain pipe 20.

All other components of the embodiment of FIG. 2 are similar to those of the embodiment of FIG. 1, and therefore further description and explanation thereof are not necessary. In both of the embodiments of FIGS. 1 and 2, the machine will be provided with additional conventional components, for example filters, pressure switches, programmer, etc., which are not shown or described herein, since they are of per se known and conventional structure and do not form any portion of the present invention.

Figure 4:
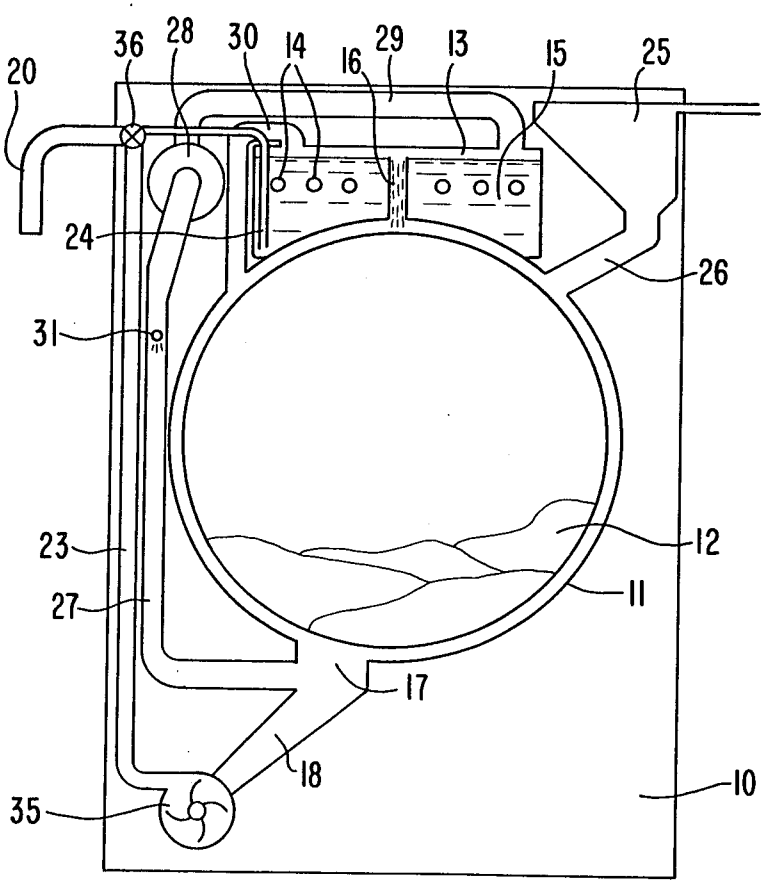
FIGS. 3 and 4 are similar views but wherein the embodiments of FIGS. 1 and 2, respectively, are modified to allow for drying of the laundry in addition to washing thereof.
Figure 3:
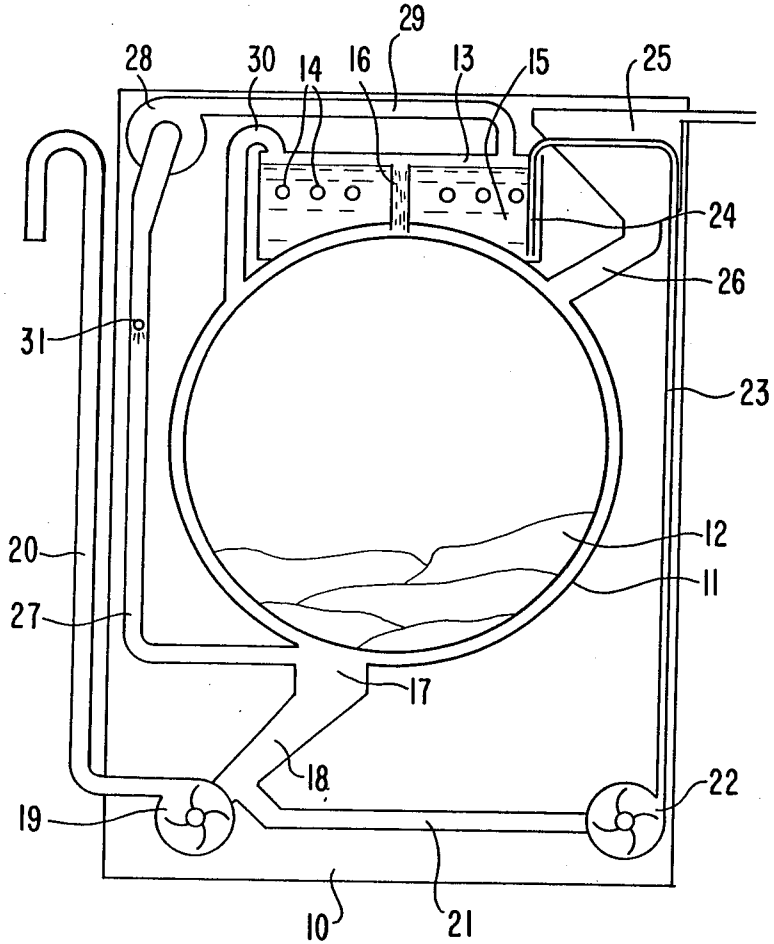

FIGS. 3 and 4 illustrate the machines of FIGS. 1 and 2, respectively, but modified to enable, in addition to laundry washing, drying of the laundry.

Thus, FIG. 3 illustrates a combined washing and drying machine in which the washing and drying functions are integrated due to the provision of the particular recirculation type washing system of the present invention which provides the chamber 13 in which are located the electrical resistance heating elements. Thus, the hydraulic portion of the machine of FIG. 3 corresponds to that of FIG. 1. However, in addition there is provided a drying circuit. Thus, to the lower port 17 at the bottom of wash tub 11 is connected an air pipe 27 within which is located an air recirculating fan 28 at a position in the upper portion of cabinet 10 and connected to chamber 13 via a conduit 29. Accordingly, fan 28 recirculates air from the bottom of wash tub 11 to chamber 13 and from there back into the upper portion of wash tub 11. Preferably, chamber 13 is provided with an additional air circulation conduit or duct 30 leading from the top of chamber 13 into the interior of wash tub 11.

In accordance with this embodiment of the present invention, washing and drying of laundry is achieved by washing and drying circuits which are integrated into a single machine. The washing circuit includes tub 11, drain pump 19, recirculation pump 22 and chamber 13. On the other hand, the drying air circuit includes tub 11, fan 28 and chamber 13. Electrical resistor heating elements 14 are located in chamber 13 and are employed for heating both the washing liquid and the drying air prior to the introduction thereof into the upper portion of the wash tub 11.

The embodiment of FIG. 3 includes an additional feature. Thus, a nozzle 31 extends into air duct 27 at a position upstream of fan 28 to supply water into air duct 27 to condense any water vapor from the air which is withdrawn from wash tub 11 by fan 28. Nozzle 31 may be connected to the hydraulic supply network, i.e. to the source of water. Water injected by nozzle 31 into duct 27 condenses water vapor from the air being circulated therethrough. This condensate falls down along duct 27 and is discharged by means of drain pump 19. Thus, this embodiment of the present invention enables the provision of a combined laundry washing and drying machine which is simplified and much more practical than known machines, thus making it particularly suitable for domestic use, while making possible savings of water, detergent and energy, both during the drying and washing cycles.

FIG. 4 illustrates a modification of the arrangement of FIG. 3, but adapted to the machine of FIG. 2. It is believed that the operation of the embodiment of FIG. 4 will be apparent from the above discussion of the operation of the embodiments of FIGS. 2 and 3.

In accordance with the present invention, it is possible to provide a washing machine which achieves effective and efficient integration of the circulation and heating of the washing liquid to maximize wetting of the laundry. The container defining chamber 13 is secured to the exterior top or ceiling of wash tub 11 and contains electrical resistor heating elements 14, and this achieves improved heating of the washing liquid which is substantially immediately supplied to the laundry without heat loss or dissipation. As a result, the solution of the present invention further reduces the consumption of energy and ensures better cleaning and protection of the heating elements. Furthermore, in accordance with the present invention, it is possible to supplement the washing machine with drying capability without requiring any substantial modification of the basic washing machine. The machine of the present invention can be of the front loading or of the top loading type without modifying the basic structure and dimensions of the respective types of machines.

Although the present invention has been described and illustrated with respect to preferred embodiments thereof, it is to be understood that various changes and modifications may be made to the specifically described and illustrated features without departing from the scope of the present invention.

We claim:

1. In a laundry washing and drying machine including a wash tub, a basket for receiving laundry and mounted for rotation within said wash tub, a recirculating duct extending from the bottom of said wash tub to an upper portion thereof, pump means for recirculating washing liquid through said duct from said bottom of said wash tub to said upper portion thereof, and electrical resistor heating means located externally of said wash tub for heating washing liquid prior to passage thereof to said upper portion of said wash tub, the improvement comprising:

a housing attached to the top of said wash tub and defining a chamber;

said duct extending into said housing such that washing liquid pumped by said pump means through said duct is discharged into said chamber;

means, positioned within said chamber and connected to the interior of said wash tub, defining a weir for the overflow of washing liquid collected in said chamber into said interior of said wash tub;

an air duct extending from said bottom of said wash tub to said chamber;

fan means for recirculating air from said wash tub, through said air duct, into said chamber, and then through said weir defining means into said wash tub, whereby laundry within said basket may be dried by the thus recirculated air; and said heating means being located within said chamber and thereby heating both said washing liquid and the recirculated air prior to the passage thereof from said chamber into said wash tub.

2. The improvement claimed in claim 1, wherein said heating means is located within said chamber at a level below the overflow level of said weir.

3. The improvement claimed in claim 1, wherein said duct includes a discharge end portion extending to a position in close proximity to the bottom of said chamber, thereby forming a siphon to enable removal through said duct of washing liquid within said chamber.

4. The improvement claimed in claim 1, wherein said pump means also is operable for discharging washing liquid to a drain pipe, and further comprising valve means for controlling the discharge of washing liquid pumped by said pump means selectively to said chamber or to said drain pipe.

5. The improvement claimed in claim 1, further comprising an additional air circulation duct extending from said chamber to said interior of said wash tub.

6. The improvement claimed in claim 1, further comprising nozzle means, extending into said air duct at a position upstream of said fan means, for supplying water into said air duct for condensing water vapor from said air circulating through said air duct.

* * * * *